United States Patent [19]

Fox

[11] Patent Number: 4,914,340

[45] Date of Patent: Apr. 3, 1990

[54] TRASH COMPACTOR LOADING DOOR CONSTRUCTION

[75] Inventor: Anthony Fox, Bloomington, Minn.

[73] Assignee: TFC Corporation, Bloomington, Minn.

[21] Appl. No.: 342,074

[22] Filed: Apr. 24, 1989

[51] Int. Cl.[4] ..... B30B 15/06

[52] U.S. Cl. ..... 312/211; 312/328; 312/320; 100/229 A

[58] Field of Search ..... 100/229 A, 53, 215; 312/328, 320, 333, 292, 211

[56] References Cited

U.S. PATENT DOCUMENTS

| | | | |
|---|---|---|---|
| 1,223,455 | 4/1917 | Weiss | 312/320 X |
| 1,275,511 | 8/1918 | Welch | 312/292 X |
| 3,549,228 | 7/1968 | Aleks | 312/320 |
| 3,680,475 | 8/1972 | Gladwin | 100/229 A X |
| 3,885,467 | 5/1975 | Merkin | 100/229 A |
| 4,152,035 | 5/1979 | Fox | 312/211 |
| 4,620,479 | 11/1986 | Diamond et al. | 100/229 A |

*Primary Examiner*—Joseph Falk

*Attorney, Agent, or Firm*—Haugen and Nikolai

[57] ABSTRACT

A loading door for permitting trash to be dumped into a trash compactor comprises an outer decorative door panel having U-shaped channels extending along the side edges thereof for receiving outwardly projecting flanges formed on an inner panel. With the outer and inner panels so joined, fasteners passing through the mutually juxtaposed top edges retain the door assembly in a rigid configuration. Hinge means are provided along the side edges of the assembly for allowing the loading door to be hinged about a horizontal axis in an opening formed through the main door of the compactor.

8 Claims, 2 Drawing Sheets

TRASH COMPACTOR LOADING DOOR CONSTRUCTION

BACKGROUND OF THE INVENTION

I. Field of the Invention:

This invention relates generally to industrial and commercial trash compaction apparatus, and more particularly to an improved trash loading door assembly adapted to be mounted on the main entry door of a trash compactor and in general alignment with the trash receiving chamber thereof whereby refuse to be compacted can be dumped into the machine.

II. Discussion of the Prior Art:

In Applicant's earlier U.S. Pat. No. 4,152,035, there is described the constructional features of a cabinet for a trash or refuse compactor. That cabinet comprises a box-like structure with a top, a base or floor, a rear panel and two side panels extending therebetween to define a generally open front. An access door is mounted on hinges to rotate about a vertical axis for closing the open front. That cabinet is also functionally divided into three compartments including a "machine compartment", a "trash receiving compartment" and a "compaction compartment". The machine compartment is generally disposed at the top of the cabinet and includes the necessary motors and hydraulic equipment for driving a compaction plate through the trash receiving compartment and into the compaction chamber. Hingedly secured to the access door is trash filling door which pivots about a horizontal axis and a pair of linkages are provided for limiting the extent to which the loading door may be rotated out of the plane of the access door. When opened, it forms a chute through which the trash can conveniently be dumped.

In earlier models of trash compactors made in accordance with the Fox patent and sold by the assignee thereof, the loading door comprised four straight steel channels welded together to form an inner rectangular frame and then sheet metal panels were welded to opposed sides surfaces of the channels forming the rectangular frame to create a sandwich construction. This approach at fabricating the compactor access door requires an inordinate amount of assembly time, multiple welding and machining operations, and also is subject to premature failure due to the ability of moisture to penetrate through the seams to rust and corrode the panels. Then, too, if through the rough treatment that commercial trash compaction equipment suffer the decorative outer panel became dented or marred, the entire door assembly had to be removed and replaced.

SUMMARY OF THE INVENTION

In accordance with the present invention, there is provided a trash compactor access door which includes an outer, generally rectangular decorative panel whose opposed side edges are each bent to form a thin U-shaped channel extending along the side edges of the panel. The top and bottom edges are, in turn, bent perpendicular to the plane of the panel. The assembly further includes a box-shaped inner panel having a generally flat planar surface, but with its top, bottom and two side edges bent out of the plane at a 90° angle. The two side edges are further bent to define laterally projected flanges which are slidably insertable into the U-shaped channels formed along the side edges of the outer decorative panel. Fastened to the obverse side of the inner panel is a sheet metal chute. First and second hinge members are then welded to the lower side edges of the inner panel to allow it to be hinged in place on the access door. In accordance with the present invention, no welded channel frame is required and because the metal bending operations necessary to form the panels is simply and quickly accomplished, the final assembly of the trash loading door is greatly simplified and the overall cost of it is reduced. Moreover, should the outer decorative panel become dented or marred, it can readily be removed and replaced as an individual part and it no longer is necessary to scrap the entire door.

OBJECTS

It is accordingly the principal object of the present invention to provide a new and improved trash loading door for a trash compactor.

Another object of the invention is to provide a trash loading door for a trash compactor which may be easily and quickly assembled from relatively low cost parts, but which remains extremely rugged and able to withstand the normal abuse to which the trash compactor and its components are subjected.

Still another object of the invention is to provide a trash compactor loading door which can be readily disassembled for replacement of a damaged or unsightly part.

These and other objects and advantages of the invention will become apparent during the course of the following description when considered in light of the accompanying drawings in which like numerals in the several views refer to corresponding parts.

DESCRIPTION OF THE PREFERRED EMBODIMENT

Figure 1:
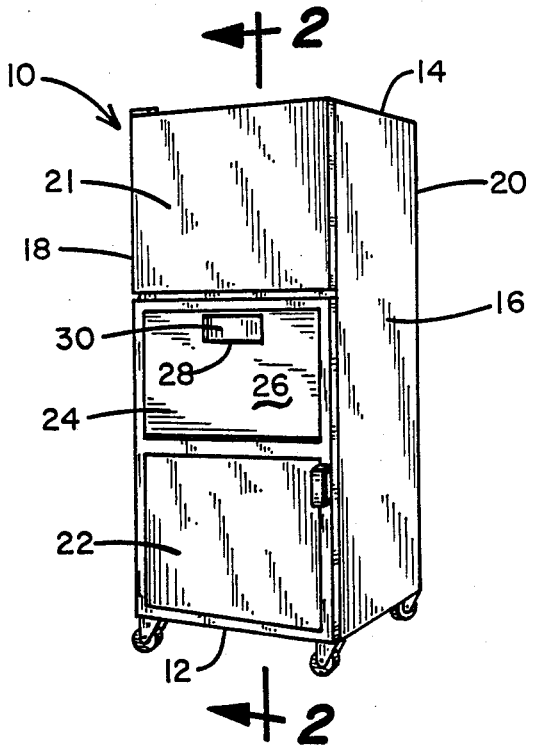
FIG. 1 is a perspective view of a trash compactor with which the present invention finds use.

Referring first to FIG. 1, the trash compactor cabinet with which the present invention finds use is indicated generally by numeral 10. It includes a base plate 12, a top plate 14, a right side panel 16, a left side panel 18 and a rear panel 20. These panels are joined together to form a generally rectangular parallelepiped of a predetermined length, width and height. Hingedly secured to the front edge of the left side panel 18 are first and second access doors 21 and 22, the access door 22 further including a hingedly mounted trash filling door 24. It is the constructional features of this latter trash filling door 24 that is the subject of the present invention.

As seen in FIG. 1, the trash loading door 24 includes an outer decorative panel 26 having a rectangular opening 28 centrally disposed from side to side and located near its upper edge. Fitted into the opening 28 is a latch handle 30. By gripping the latch handle 30 and pulling outwardly thereon, a spring-loaded latch (not shown in FIG. 1) is retracted, allowing the trash loading door 24 to swing open about a horizontal axis located just above the bottom edge of the access door as best seen in the cross-sectional view of FIG. 2.

Figure 2:
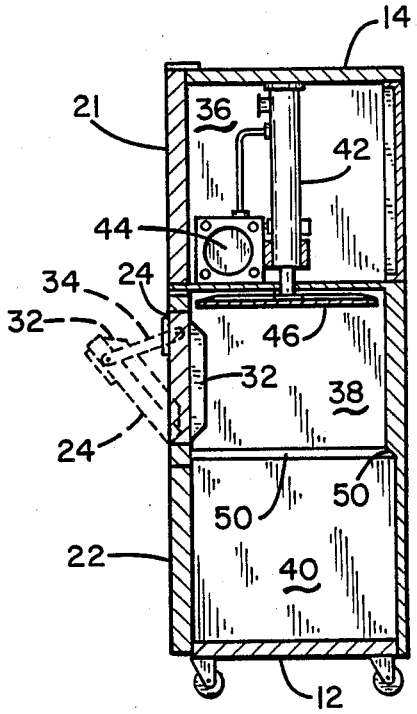
FIG. 2 is a side cross-sectional view taken along the line 2—2 in FIG. 1.

As is also visible in FIG. 2, affixed to the inside surface of the access door 24 is a chute member 32 which simply comprises a flat metal sheet whose side edges are bent at 90°. When the loading door is swung open as indicated by the dotted line representation in FIG. 2, the sides of the chute 32 help guide refuse being dumped into the compactor through the door opening. Limiting the extent to which the door 24 may be tipped open are linkages as at 34 which are pivotally connected to the side edges of the door and to the frame defining the trash loading opening in the access door 22.

The cross-sectional view of FIG. 2 also reveals that the cabinet can be considered as functionally divided into three compartments, namely, the machinery compartment 36, the trash loading compartment 38 and the compaction compartment or chamber 40. Located in the machinery compartment 36 is a hydraulic ram 42 powered by an electric motor driven hydraulic pump assembly 44. Attached to the piston of the hydraulic ram 42 is a compaction plate 46 which is capable of moving through the loading chamber 38 and into the compaction chamber 40 for compressing loose trash into a compact mass.

Having described the general constructional features of the compactor with which the door assembly of the present invention finds use, consideration will next be given to the constructional features of the door itself and, in this regard, reference will first be made to the blown-apart view of FIG. 3. In accordance with the present invention, the trash compactor loading door 24 is seen to comprise a loading door inner panel 48 and a loading door outer panel 50. The panel 4 is fabricated from sheet metal in a bending operation and includes a generally planar surface 52 which is bent at its periphery to form perpendicularly projecting side edges 54 and 56, a bottom edge 58 and a top edge 60. The side edges 54 and 56 also include integrally formed, laterally extending flanges 62 and 64. A rectangular notch 66 is cut into the top edge 60 of the inner panel 48.

Figure 3:
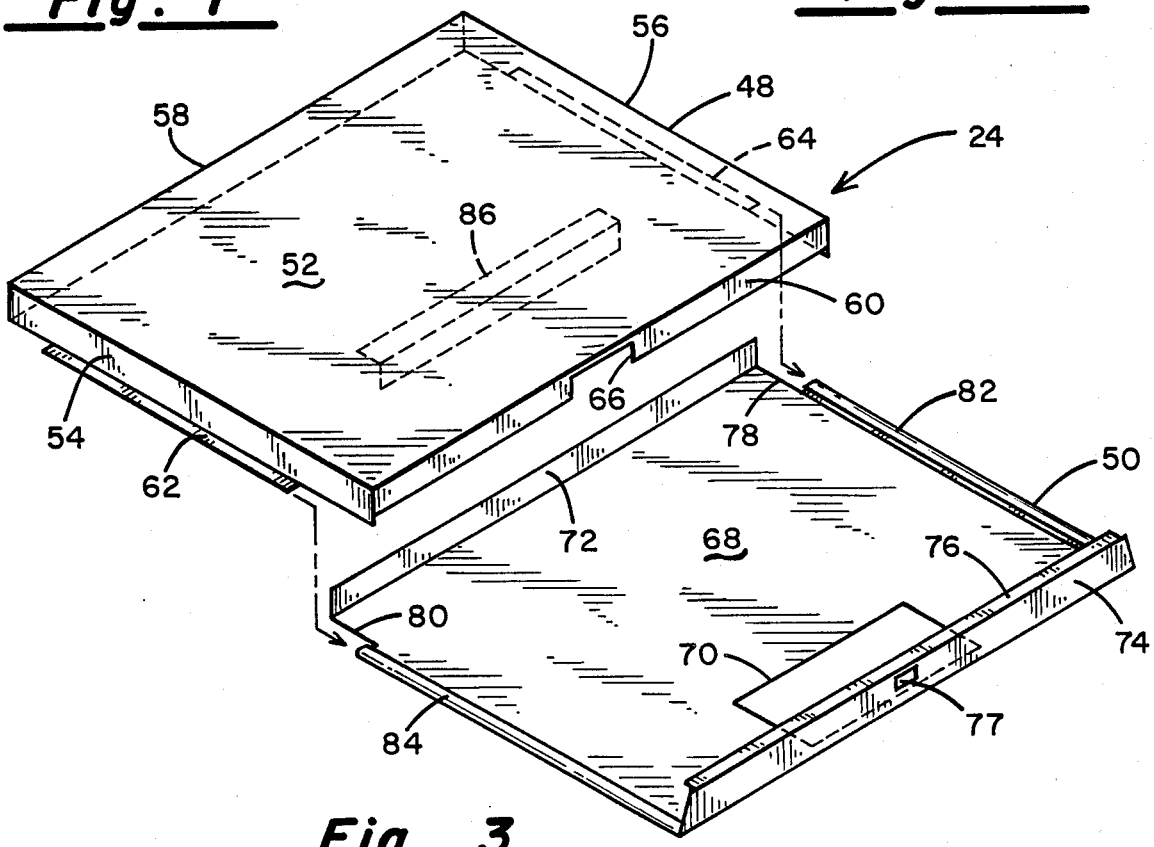
FIG. 3 is a first blown-apart view illustrating the constructional features of the outer and inner panels and the way they fit together.
Figure 4:
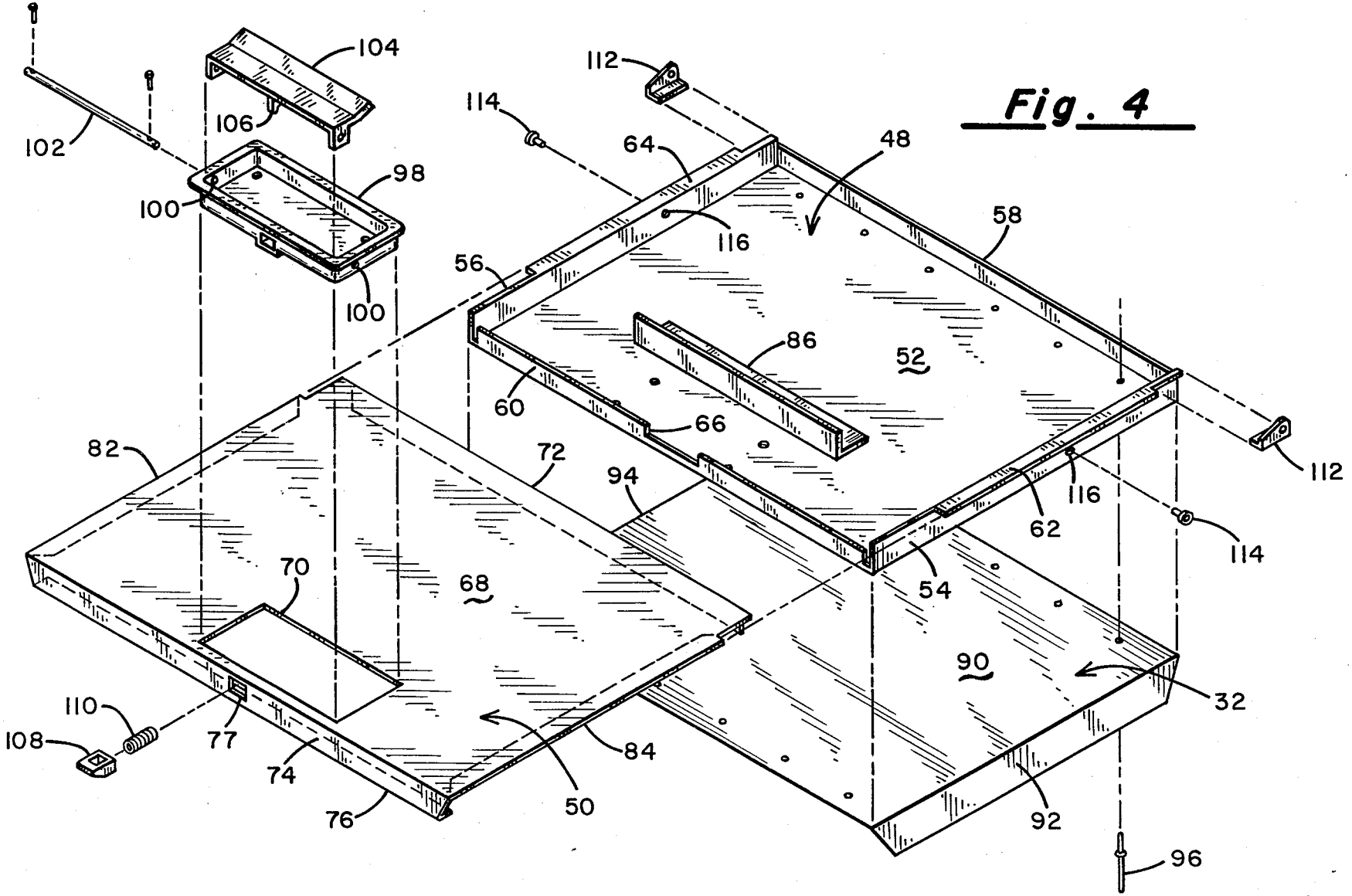
FIG. 4 is a more detailed blown-apart view of the entire trash loading door assembly.

With continued reference to FIG. 3, the loading door outer decorative panel 50 is seen to include a flat surface 68 having a rectangular cutout 70 for receiving a door latch release handle as yet to be described. The panel 68 has an integrally formed lower edge 72 bent out of the plane of the surface 68 at 90°. Likewise the top edge 74 is also bent so as to extend generally parallel to the bottom edge 72 and that edge 74 is, in turn, bent again in the reverse direction to create a downwardly projecting channel edge 76. It includes a small rectangular opening 77 for receiving a door latch 108 (FIG. 4). With further reference to the loading door outer panel 50, it is seen to include along its side edges 78 and 80 integrally formed, U-shaped channel 82 and 84 into which the flanges 62 and 64 of the inner panel 48 may be slipped as indicated by the arrows. When the inner and outer panels are properly seated, the upper edge 74 of the outer panel will abut the upper edge 60 of the inner panel with the terminal portion 76 slightly overlapping the surface 52 of the inner door panel. While not absolutely required, it may prove beneficial to include a reinforcing spacer between the inner surface of the outer panel and the inner surface of the inner panel. In FIG. 3, the reinforcing spacer is illustrated as comprising a piece of angle bar 86 spot-welded to the inner surface of the inner panel.

The blown-apart view of FIG. 4 illustrates further details of the door panel construction. It has already been explained how the loading door inner panel 48 and the loading door outer panel 50 slip together to form a generally closed, sturdy box whose major surfaces are maintained in spaced-apart condition by a reinforcing spacer member 86. FIG. 4 also illustrates how the chute member 32 attaches to the outer surface of the inner door panel 48. Chute 32 comprises a channel formed from sheet metal, such as stainless steel, and includes a flat planar base surface 90 and two opposed, normally extending side edges 92 and 94. The surfaces 52 and 90 are drilled for receiving pop rivets 96 therethrough for holding the chute 32 in place on the inner loading door panel 48.

Fitted into the latch handle receiving opening 70 in the outer loading door panel 50 is a molded metal insert 98 having aligned apertures 100 extending through the side walls thereof for receiving a hinge pin 102 used to secure the door latch handle 104 in place in the insert 98. The door latch handle 104 has a downwardly extending finger 106 which is intended to mate with a latch member 108 fitted through the opening 77 in the outer door panel 50 such that pivotal rotation of the door handle will move the latch 108 reciprocally against the force of a loading spring 110 used to normally bias the latch 108 out through the latch opening 77.

Completing the loading door assembly are a pair of hinge members 112 which are welded in place on the side edges 54 and 56 of the loading door inner panel 48 proximate the lower or bottom edge 58 thereof. As was explained in connection with FIG. 2, the hinges 112 mate with corresponding hinge plates mounted on the access door 22 to permit the trash loading door 24 to be tipped out of the plane of the access door 21, thus exposing the interior of the trash loading compartment 38. Weldnuts as at 114 pass through aligned bores 116 in the side walls 54 and 56 and provide a means whereby the linkages 34 limiting the swing travel of the loading door assembly are attached to the loading door.

Because of the manner in which the inner and outer door panels are formed from sheet metal with flanges on one insertable into U-shaped channels on the other, the need for extensive welding of an intermediate framework is eliminated yet without detracting from the strength and ruggedness of the resulting product. Should the decorative outer panel become dented or scratched, it is a simple matter to remove that panel and replace it with a new one without having to scrap the removing portions of the door assembly.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. In a trash compactor of the type including a frame supporting three mutually perpendicular stationary side walls, a top and a base forming a cabinet, said cabinet having an open front, a relatively large door hinged to said frame for opening and closing relative to said open front, said cabinet being functionally divided into three compartments including an upper machinery compartment, a middle trash loading compartment and a lower compaction compartment, said relative larger door including a generally rectangular opening therethrough for receiving trash in alignment with said trash receiving compartment, an improved trash loading door comprising:

(a) an outer generally rectangular decorative panel having first and second side edges each bent to form thin U-shaped channels extending along a major portion of said side edges, the top and bottom edges of said decorative panel being bent perpendicular to the plane of said panel providing top and bottom stiffeners therefor and a rectangular latch handle. receiving opening formed through said panel next to said top edge and centered between said side edges;

(b) a box-shaped inner panel having a generally flat planar surface with its top, bottom and two side edges bent out of said flat plane at a 90° angle, said two side edges further having a major portion thereof bent to define laterally projecting flanges matching and slidably insertable into said thin U-shaped channels extending along said side edges of said outer decorative panel said top and bottom stiffeners of said decorative panel further cooperating with said bent top and bottom edges of said inner panel to complete a closed structure in a manner whereby said outer decorative panel provides a slidably removable cover for a first side of said planer surface interior to the box-shaped structure;

(c) mean defining a chute with and secured to a second side of said planar surface of said inner panel; and (d) a pair of hinge halves affixed to said two side edges of said inner panel at said bottom edge for mating with corresponding hinge halves secured to said relatively larger door at said rectangular opening therethrough to allow said trash loading door to pivot about a horizontal axis.

2. The trash loading door as in claim 1 and further including:

(a) a spring-loaded latch projecting through openings formed in said top edges of said inner and outer panels; and (b) a latch handle pivotally mounted in said latch handle receiving opening of said decorative panel and coupled to said spring-loaded latch for retracting said spring-loaded latch when said latch handle is pulled.

3. The trash loading door as in claim 1 and further including reinforcing spacer means disposed between said outer and inner panels.

4. The trash loading door as in claim 1 wherein said means defining a chute secured to said second side of the inner panel is a generally rectangular member substantially covering said second side of said inner panel and having side edges bent out away from the plane of the surface of said inner panel.

5. The trash loading door as in claim 4 wherein said chute member is constructed of corrosion resistant material.

6. The trash loading door as in claim 5 wherein said chute member is stainless steel.

7. The trash loading door as in claim 1 and further including removable fastener means for securing said outer and said inner panels together when assembled.

8. The trash loading door as in claim 7 wherein said means for securing said outer and inner panel together further secures an insert means for receiving a latch mechanism in said rectangular latch handle receiving opening.

* * * * *